United States Patent [19]

Crouch

[11] 4,006,331

[45] Feb. 1, 1977

[54] VACUUM INTERRUPTER FOR HIGH VOLTAGE APPLICATIONS

[75] Inventor: Donald W. Crouch, Newtown Square, Pa.

[73] Assignee: General Electric Company, Philadelphia, Pa.

[22] Filed: Aug. 27, 1975

[21] Appl. No.: 608,368

[52] U.S. Cl. ..... 200/144 B

[51] Int. Cl.[2] ..... H01H 33/66

[58] Field of Search ..... 200/144 B

[56] References Cited

UNITED STATES PATENTS

| | | | |
|---|---|---|---|
| 3,185,797 | 5/1965 | Porter | 200/144 B |
| 3,185,800 | 5/1965 | Titus | 200/144 B |
| 3,612,795 | 10/1971 | Emmerich | 200/144 B |
| 3,792,214 | 2/1974 | Voshall | 200/144 B |
| 3,903,386 | 9/1975 | Yanagisawa | 200/144 B |

*Primary Examiner*—Robert S. Macon

*Attorney, Agent, or Firm*—William Freedman

[57] ABSTRACT

This vacuum interrupter is for high voltage applications and comprises a tubular metal central shield around its arcing gap for condensing arc-generated vapors and two tubular metal end shields located at opposite ends of the interrupter. Two tubular metal intermediate shields are respectively provided at opposite ends of the central shield between the central shield and the adjacent end shields. These intermediate shields are normally electrically isolated from the central shield and the end shields. Each intermediate shield is disposed adjacent to the central shield but does not axially overlap with the central shield. Each intermediate shield also surrounds the inner end of its associated end shield in radially-spaced, axially-overlapping relationship with the associated end shield.

5 Claims, 1 Drawing Figure

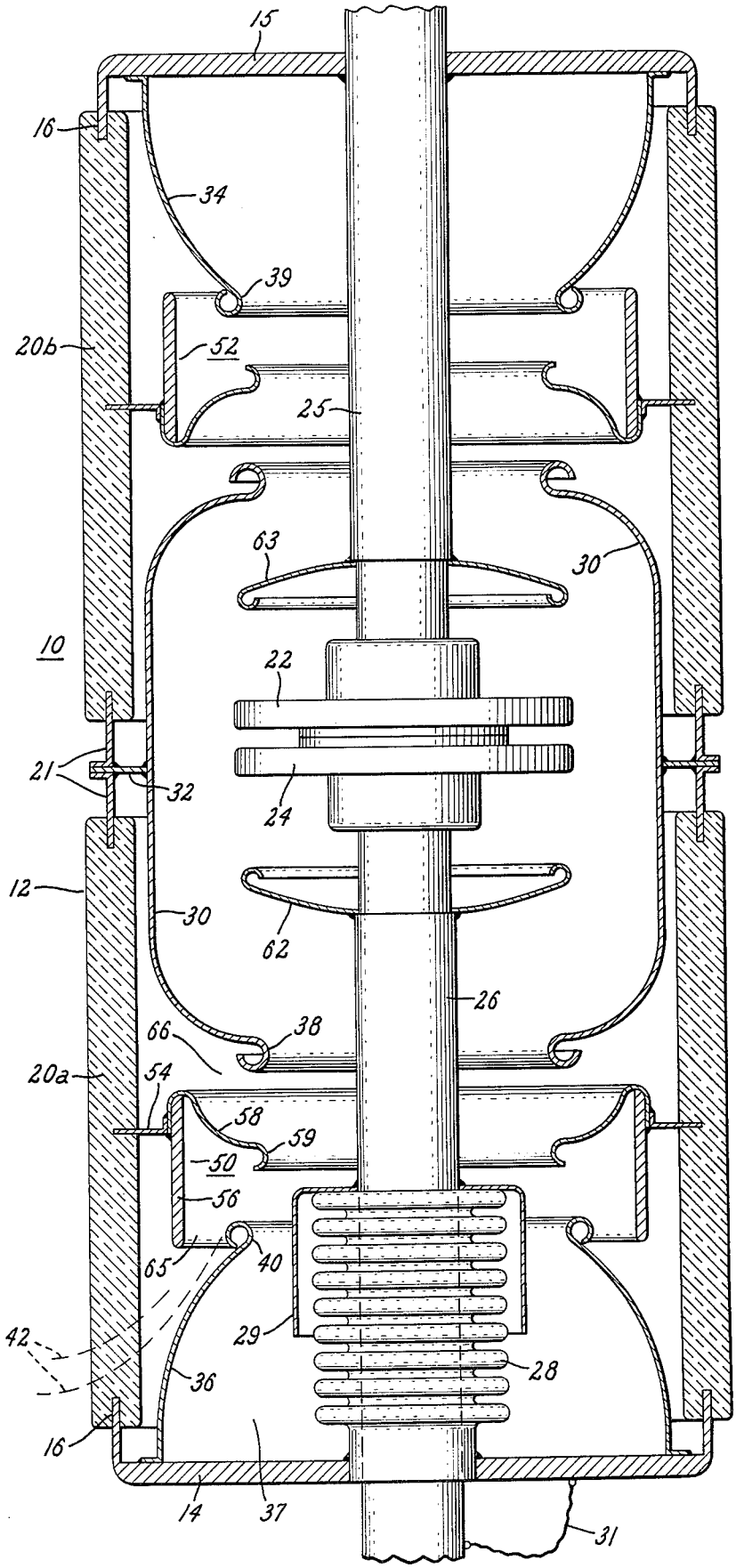
15
16
34
39
20b
52
25
63
30
10
22
21
32
24
12
30
62
26
66
38
20a
54
58
59
50
56
65
40
42
29
28
36
16
14
37
31

VACUUM INTERRUPTER FOR HIGH VOLTAGE APPLICATIONS

BACKGROUND

This invention relates to a vacuum-type circuit interrupter and, more particularly, to a vacuum interrupter that has exceptional capability for withstanding high voltages.

It is conventional to include in a vacuum interrupter a centrally-located tubular metal shield that surrounds the arcing gap of the interrupter and is capable of intercepting and condensing arcing products before they can reach the insulating housing of the interrupter. Typically, this central shield is electrically isolated from both contacts of the interrupter. It is also conventional to provide the interrupter with end shields at its opposite ends respectively electrically connected to the two contacts of the interrupter for aiding in intercepting and condensing the arcing products. These end shields are electrically isolated from the central shield by vacuum gaps at opposite ends of the central shield. Examples of such vacuum interrupters are shown in U.S. Pat. No. 2,892,912-Greenwood et al, and U.S. Pat. No. 3,441,698-Sofianek, both assigned to the assignee of the present invention.

It has been proposed to provide intermediate shields between the end shields and the central shield to further assist in intercepting and condensing arcing products and also to divide each gap between the central and end shields into series-related gaps. Typically, the resulting series-related gaps collectively have a higher dielectric strength than the larger gaps that they replace. Examples of such interrupters are shown in U.S. Pat. Nos. 3,185,800-Titus and 3,792,214-Voshall.

SUMMARY

The present invention is concerned with a vacuum interrupter of this latter type. An object of the present invention is to incorporate and construct the intermediate shields in such a way that they can effectively perform their desired functions referred to hereinabove and yet are simple in construction and do not require for their incorporation into the interrupter substantial increases in the length or diameter of the housing of the interrupter.

Another object is to provide in such an interrupter end shields of a simple design that are so incorporated in the interrupter that each can perform the dual function of (1) providing a zone essentially free of electric stress in which arcing products can be readily trapped and condensed, and (2) electrostatically shielding the seal between the associated metal end cap and the insulating housing of the interrupter.

In carrying out the invention in one form, I provide a vacuum interrupter that includes a tubular metal central shield surrounding the arcing gap of the interrupter and normally electrically isolated from both contacts of the interrupter. At opposite ends of the interrupter housing and respectively electrically connected to the contacts of the interrupter are first and second tubular metal end shields. Between the central shield and the first end shield, I provide a tubular metal intermediate shield that is normally electrically isolated from the central shield and said first end shield. Between the central shield and the second end shield, I provide a second tubular metal intermediate shield, and this second intermediate shield is normally electrically isolated from the central shield and said second end shield.

The first intermediate shield has one end adjacent a first end of the central shield but spaced axially of the housing from said first end of the central shield, with no axial overlap between said first intermediate shield and the central shield. The first intermediate shield has an opposite end adjacent the inner end of the first end shield and surrounding said inner end of the first end shield in radially-spaced, axially-overlapping relation thereto.

The second intermediate shield is positioned with respect to the second end shield and the central shield in the substantially same way as the first intermediate shield is positioned with respect to the central shield and its associated end shield.

BRIEF DESCRIPTION OF DRAWING

For a better understanding of the invention, reference may be had to the accompanying drawing in which:

The single FIGURE is a side elevational view mostly in section showing a vacuum interrupter embodying one form of the present invention.

DETAILED DESCRIPTION OF PREFERRED EMBODIMENT

Referring now to the drawing, the vacuum interrupter shown therein comprises a highly-evacuated envelope 10 comprising a tubular housing 12 primarily of insulating material and a pair of metal end caps 14 and 15 located at opposite ends of the housing and joined thereto by vacuum-tight seals 16. In the illustrated embodiment, the tubular housing 12 comprises two tubular sections 20*a* and 20*b* primarily of insulating material joined together by means of a tubular metal mid-band 21 that has its opposite ends sealed to the tubular sections 20*a* and 20*b*.

Within the housing 12 is a pair of separable contacts 22 and 24. Contact 22 is a stationary contact fixed to a stationary conductive contact rod 25 that extends in sealed relationship through upper end cap 15. Contact 24 is a movable contact supported on a movable contact rod 26 that extends freely through the lower end cap 14. A flexible metal bellows 28 joined at its opposite ends to end cap 14 and contact rod 26 provides a vacuum-tight seal about movable contact rod 26 that allows it to be moved axially without impairing the vacuum within the evacuated envelope 10.

A cup-shaped metal shield 29 fixed to movable contact rod 26 surrounds bellows 28 to protect the bellows from hot arcing products and also to provide electrostatic shielding for the bellows.

It is to be understood that the two metal end caps are electrically connected to the contact rods that respectively pass therethrough. The connection between end cap 15 and contact rod 25 is a brazed joint, and the connection between end cap 14 and movable contact rod 26 is through a suitable flexible braid schematically shown at 31.

Opening of the interrupter is effected by driving the movable contact rod 26 downwardly to separate contacts 24 and 22. This establishes an arcing gap between the contacts across which an arc is drawn. Current flows through the arc until about the instant of a natural current zero, at which time the arc is prevented from re-igniting by the high dielectric strength of the vacuum.

For condensing the metal vapors generated by the arc, a tubular metal central shield 30 is provided about the arcing gap. This shield 30 normally is electrically isolated from both contacts 22 and 24. It has a radially-outwardly extending mounting flange 32 that is suitably supported on the metal mid-band 21. Metal vapors emitted from the arcing gap by the arc are intercepted and condensed by the shield 30 and this aids the interrupter in recovering its dielectric strength at a current zero as well as protecting the insulating housing from being coated with metal particles deposited from the metal vapors.

To further aid in condensing the metal vapors generated by arcing between the contacts, a pair of end shields 34 and 36 are provided at opposite ends of the envelope 10. Each of these end shields is a tubular metal member suitably joined to and electrically connected to its associated end cap 14 or 15. A space 37 enclosed by each end shield is a region essentially free of electric stress since it is bounded on substantially all sides, except its open end, by metal parts of the same potential and it contains no parts of any substantially different potential. The absence of substantial electrical stress in this region 37 contributes to more efficient trapping and condensation of the metal particles since there is less chance for the particles rebounding under the influence of the electric field. Moreover, surface roughness produced by such condensation is less likely to trigger an electric breakdown in this region in view of the very low electric stresses at the surface. The advantages of providing low stress regions at the ends of a vacuum interrupter for trapping arcing products are described in more detail in U.S. Pat. No. 3,441,698-Sofianek.

Our end shields 34 and 36 also serve to reduce the electric field intensity in the region of the seals 16. Since each of these tubular metal parts 34 and 36 extends closely adjacent the inner insulating wall of the cylindrical insulating housing 12 toward the central region of the interrupter, the electric field in the region of the seal has a relatively low intensity. An electrostatic shielding effect is present tending to force the equipotential lines of nearby potentials away from the end of the adjacent seal, as illustrated by the approximate configuration of such equipotential lines at 42 adjacent the lower seal 16. This shielding effect for the seal desirably counteracts the known tendency for electric stresses to concentrate at glass-to-metal interfaces such as present at seal 16.

To reduce electrical stresses at the end of the shields 30, 34, and 36, conventional stress-relieving rings 38, 39 and 40 are provided at the ends of the shields. These rings may be formed by spinning over these ends to provide toroids of generally circular cross-section.

To reduce the chance that metal vapor will reach insulating housing 12 via a path between the central shield and an adjacent end shield 34 or 36, intermediate shields 50 and 52 are provided. Intermediate shield 50 is located between the central shield 30 and end shield 36, and intermediate shield 52 is located between the central shield 30 and end shield 34. Since these intermediate shields are substantially identical, only one of the intermediate shields (50) will be described in detail.

Intermediate shield 50 is of a generally tubular form and is supported on insulting housing section **20*a* in such a manner that normally it is electrically isolated from end shield 36 and central shield 30. In the illustrated embodiment, a support ring 54 extends through the insulating housing section 20*a* in sealed relationship to the housing section at a location approximately equidistance from the ends of the housing section. Intermediate shield 50 is suitably attached to support ring 54** at the inner ring of the support ring.

Intermediate shield 50 comprises a cylindrical member 56 that has one end axially overlapping and surrounding in radially-spaced relationship the upper, or inner, end of end shield 36. Intermediate shield 50 further comprises an annular disc 58 of sheet metal located at the opposite end of cylinder 56. This annular metal disc 58 extends radially inward from cylinder 56 into the space between the end rings 40 and 38 at the extremities of the end shield and the central shield. Disc 58 has a central opening surrounding and radially spaced from contact rod 26. The inner periphery of the disc is rounded at 59 to reduce electric stress concentrations in this region. Disc 58, in effect, divides the space between rings 40 and 38 into two series-related gaps. There is less likelihood, under conditions of high voltage stress, that these two gaps will break down simultaneously than there would be of a breakdown between rings 40 and 38 if the disc 58 was absent.

It will be noted that the metal disc 58 is especially well situated to intercept any metal vapors discharging through the open end of the central shield 30 and directed toward the gap 65 between the cylinder 56 and the end shield 36 since this path is, to a large extent, blocked by the disc 58. While disc 58 does not as effectively block entry to the gap 66 adjacent the opposite, or upper, end of the intermediate 50, this is not a significant problem because the metal vapors discharging through the lower end of the central shield 30 are directed primarily downward and thus more naturally tend to bypass the gap at the upper end of the intermediate shield 50.

The upper end of intermediate shield 50, although located closely adjacent the lower end of central shield 30, does not axially overlap the central shield. By avoiding such axial overlapping, I am able to provide the required clearances between parts 50 and 30 without the need for increasing the diameter of the intermediate shield 50 or the surrounding insulating housing section **20*a*, one or both of which would be required if substantial axial overlap was present between parts 30 and 50.**

I am able to provide axial overlap at the other end of intermediate shield 50 (i.e., between shields 50 and 36) because I have much more latitude here (than at 38) to reduce the diameter of the cooperating shield. More specifically, since there is no voltage between the inner end 40 of the end shield and the bellows shield 29, the inner end of the end shield can be located relatively close to the bellows shield with no risk of an electrical breakdown between these parts. The ring 38 on the central shield cannot, however, be so readily reduced in diameter since a high voltage is present between ring 38 and the contact rod 26.

Locating the cylindrical portion 56 of the intermediate shield 50 in a position radially outward of the ends 38 and 40 of the shields 30 and 36 permits the above-described axial overlapping between shields 50 and 36. This axial overlapping enables me to reduce the effective length of the shielding. The cylindrical portion 56 serves to provide additional means for intercepting any metal vapors that might find their way into the space between disc 58 and the upper end 40 of shield 36.

It is to be noted that the intermediate shield 50 is located in a position spaced by a substantial distance axially inward of the insulating housing 12 from the seal 16 and thus does not interfere with the above-described electrostatic shielding of seal 16 performed by the end shield 36.

Although not specifically illustrated, the contacts 22 and 24 contain slots such as shown in U.S. Pat. No. 3,441,698-Sofianek for facilitating arc-motion on the contacts. Some of the arcing products will be expelled through these slots in a direction axially of the interrupter. To limit the quantity of these axially-directed arcing products that are able to discharge through the open ends of central shield 30, I provide two auxiliary shields 62 and 63 of disc form on the respective contact rods. Auxiliary shield 62 is fixed to movable contact rod 26 in a position just below contact 24, and auxiliary shield 63 is fixed to stationary contact rod 25 in a position just above stationary contact 22. These auxiliary shields intercept and condense a large portion of the axially-directed arcing products before they can discharge through the open ends of a central shield 30.

The net result of the above-described efficient trapping of metal arcing products and the plural vacuum gaps at each end of the central shield is to impart to the interrupter exceptional ability to withstand high voltages even after repeated interrupting operations.

While I have shown and described in particular embodiment of my invention, it will be obvious to those skilled in the art that various changes and modifications may be made without departing from my invention in its broader aspects; and I, therefore, intend in the appended claims to cover all such changes and modifications as fall within the true spirit and scope of my invention.

What I claim as new and desire to secure by Letters Patent of the United States is:

1. A vacuum-type circuit interrupter comprising:

a. a highly evacuated envelope comprising a tubular insulating housing and metal end caps at opposite ends of said housing, b. a first contact generally radially centered in said insulating housing and a first conductive rod supporting said first contact and electrically connected to one of said end caps, c. a second contact movable along the central longitudinal axis of said insulating housing between a closed position in engagement with said first contact and an open position displaced from said first contact to establish an arcing gap therebetween, d. a second conductive contact rod supporting said second contact and electrically connected to the other of said end caps, e. a tubular metal central shield within said housing surrounding the arcing gap, normally electrically isolated from both of said contacts, and having first and second ends at its opposite extremities, f. a pair of tubular metal end shields respectively electrically connected to said end caps, a first one of said end shields surrounding said first contact rod and a second one of said end shields surrounding said second contact rod, g. a pair of tubular metal intermediate shields, a first one of which is disposed between said first end shield and said central shield and a second one of which is disposed between said second end shield and said central shield, h. said first intermediate shield normally being electrically isolated from said first end shield and said central shield, and said second intermediate shield normally being electrically isolated from said second end shield and said central shield, i. said first intermediate shield having one end adjacent to said first end of said central shield but spaced axially of said first contact rod from said first end of said central shield, with no axial overlap between said first intermediate shield and said central shield, j. said second intermediate shield having one end adjacent to said second end of said central shield but spaced axially of said second contact rod from said second end of said central shield, with no axial overlap between said second intermediate shield and said central shield, k. said first intermediate shield having a second end adjacent the inner end of said first end shield and surrounding said inner end of the first end shield in radially-spaced, axially-overlapping relation thereto, l. said second intermediate shield having a second end adjacent the inner end of said second end shield and surrounding said inner end of the second end shield in radially-spaced, axially-overlapping relation thereto.

2. The vacuum interrupter of claim 1 in which:

a. said first intermediate shield comprises: (i) a generally cylindrical portion located in a position disposed radially outward of said first end of said central shield and the inner end of said first end shield, and (ii) a disc portion extending generally radially inward from said cylindrical portion into the region where the first end of said central shield and the inner end of said first end shield are in closest proximity, b. said generally cylindrical portion has an extremity constituting said second end of said first intermediate shield, and c. said disc portion has a central opening therein surrounding said first contact rod in radially-spaced relationship.

3. The vacuum interrupter of claim 2 in which:

a. said second intermediate shield comprises (i) a generally cylindrical portion located in a position disposed radially outward of said second end of said central shield and the inner end of said second end shield, and (ii) a disc portion extending generally radially inward from said cylindrical portion into the region where the second end of said central shield and the inner end of said second end shield are in closest proximity, b. said generally cylindrical portion of (a) has an extremity constituting said second end of said second intermediate shield, and c. said disc portion of (a) has a central opening therein surrounding said second contact rod in radially-spaced relationship.

4. The vacuum-type circuit interrupter of claim 1 in which:

a. a first one of said metal end caps is electrically connected to said first tubular metal end shield and is joined to said tubular insulating housing by means of a first metal-to-insulating material seal, b. said first tubular end shield extends from said first end cap axially inwardly of said tubular insulating housing substantially past the location of said first seal, c. said first tubular metal end shield is located closely adjacent said tubular insulating housing in the region of said first seal, thus electrostatically shielding said first seal, d. the inner end of said first end shield has a much smaller diameter than the portion of said first end shield adjacent said first seal so that said inner end is spaced radially inwardly of said first intermediate shield by a substantial distance, and e. said first intermediate shield is located in a position spaced axially inwardly of said insulating housing from said first seal.

5. The circuit interrupter of claim 4 in which:

a. a second one of said metal end caps is electrically connected to said second tubular metal end shield and is joined to said tubular insulating housing by means of a second metal-to-insulating material seal, b. said second tubular end shield extends from said second end cap axially inwardly of said tubular insulating housing substantially past the location of said second seal, c. said second tubular metal end shield is located closely adjacent said tubular insulating housing in the region of said second seal, thus electrostatically shielding said second seal, d. the inner end of said second end shield has a much smaller diameter than the portion of said second end shield adjacent said second seal so that said inner end of said second end shield is spaced radially inwardly of said second intermediate shield by a substantial distance, and e. said second intermediate shield is located in a position spaced axially inwardly of said insulating housing from said second seal.

* * * * *